US010634326B2

(12) United States Patent
Kasmeier et al.

(10) Patent No.: US 10,634,326 B2
(45) Date of Patent: Apr. 28, 2020

(54) LIGHTING APPARATUS

(71) Applicants: John Kasmeier, Florence, AL (US); Charles Kasmeier, Florence, AL (US)

(72) Inventors: John Kasmeier, Florence, AL (US); Charles Kasmeier, Florence, AL (US)

( * ) Notice: Subject to any disclaimer, the term of this patent is extended or adjusted under 35 U.S.C. 154(b) by 0 days.

(21) Appl. No.: 16/037,819

(22) Filed: Jul. 17, 2018

(65) Prior Publication Data

US 2020/0025358 A1 Jan. 23, 2020

(51) Int. Cl.

| | |
|---|---|
| ***F21V 21/15*** | (2006.01) |
| ***F21S 8/02*** | (2006.01) |
| ***F21S 8/00*** | (2006.01) |

(52) U.S. Cl.

CPC ..... *F21V 21/15* (2013.01); *F21S 8/028* (2013.01); *F21S 8/032* (2013.01)

(58) Field of Classification Search

CPC ..... F21S 8/028; F21S 8/032

See application file for complete search history.

(56) References Cited

U.S. PATENT DOCUMENTS

| | | | | |
|---|---|---|---|---|
| 2,276,711 | A * | 3/1942 | Bilde | A47L 15/506 126/340 |
| 5,124,902 | A * | 6/1992 | Puglisi | F21S 8/028 362/153.1 |
| 5,513,085 | A * | 4/1996 | Bourne | F21S 8/028 362/286 |
| 7,819,561 | B2 * | 10/2010 | Puglisi | F21S 8/02 362/371 |
| 2008/0013317 | A1 * | 1/2008 | Hinds | F21S 8/028 362/286 |
| 2008/0055905 | A1 * | 3/2008 | Chiu | B63B 45/02 362/253 |

* cited by examiner

*Primary Examiner* — Charlie Y Peng
(74) *Attorney, Agent, or Firm* — David W Barman

(57) ABSTRACT

Present invention provides for a lighting system constructed and arranged to be positioned within a container having a lid and light mounted thereon wherein said container is constructed and arranged to be buried in the ground in a position such that the lid is substantially congruent with the planar surface of the ground.

6 Claims, 3 Drawing Sheets

LIGHTING APPARATUS

BACKGROUND OF THE INVENTION

Since the invention of the electric light bulb there have been a vast array of inventions to provide lighting. Although there are significant variations in lighting apparatus, there always seems to arise new and unique situations for which current configurations are inadequate. The present invention addresses a need that has gone unaddressed until now.

SUMMARY OF THE INVENTION

In one embodiment, the present invention provides a lighting apparatus to encased in a durable enclosure that is configured to be buried in the ground and concealed when not in use. As desired, a user can either manually, remotely, automatically, or combinations thereof, open a cover in order to utilize the lighting system. This configuration is contemplated to illuminate any structure including homes, businesses, parks, and the like without limitation.

In one embodiment, the present invention is a light system comprising:

an enclosure having a central cavity accessible by a lid;

a mechanism constructed and arranged to open and closed said lid based on actuation;

a light mounted on said lid an actuator; and a source of power.

In one embodiment, the lid opens and closes about a hinge.

In one embodiment, the actuator is a wireless actuator, a hardwired actuator, a motion sensor, a chronological timer, or combinations thereof.

In one embodiment, the source of power is conventionally utilized alternating current.

In one embodiment, the mechanism constructed and arranged to open and close said lid is an extendable lid support.

In one embodiment, the mechanism constructed and arranged to open and close said lid is a fixed length lid support movable within said central cavity along a track constructed and arranged to ultimately open and close said lid as desired.

DETAILED DESCRIPTION OF THE PREFERRED EMBODIMENT

Figure 1:
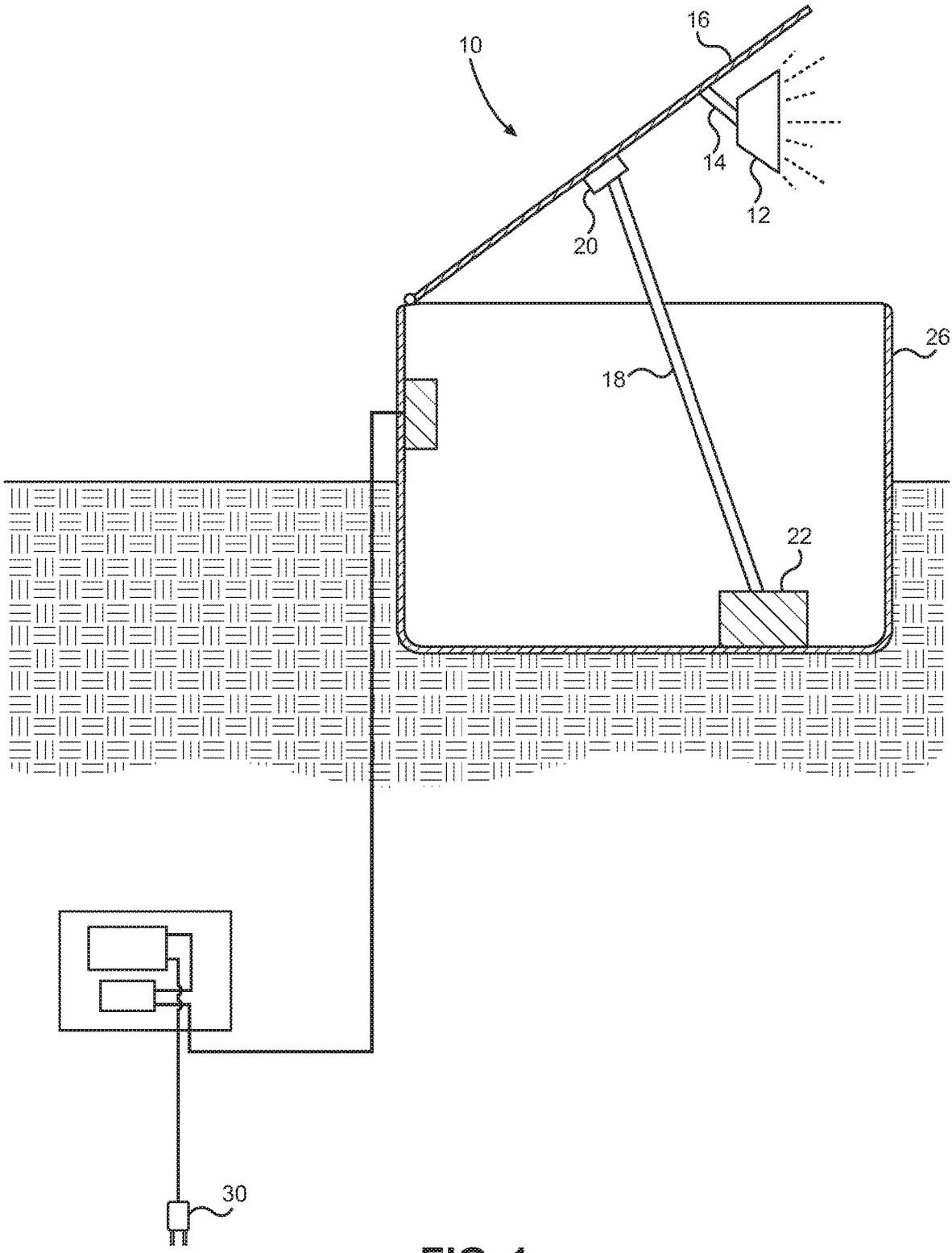
FIG. 1 is a side partial cross-section view of the lighting system of the present invention.

As generally understood, system 10 includes an enclosure 26 constructed and arranged with a removable lid 16. Light source 12 is attached to light source support 14 that is ultimately attached to lid 16. Lid support 18 is attached on one end to lid mounting bracket 20 and on and opposite end to lid support base 22. In one environment, lid support base motor 22 is constructed and arranged with remote actuated electronics in order to open and close lid 16. In one embodiment, a remote control actuates a lift motor that extends lid support 18 and subsequently raises lid 16. As generally understood, a power source 30 provides power to system 10.

Figure 2:
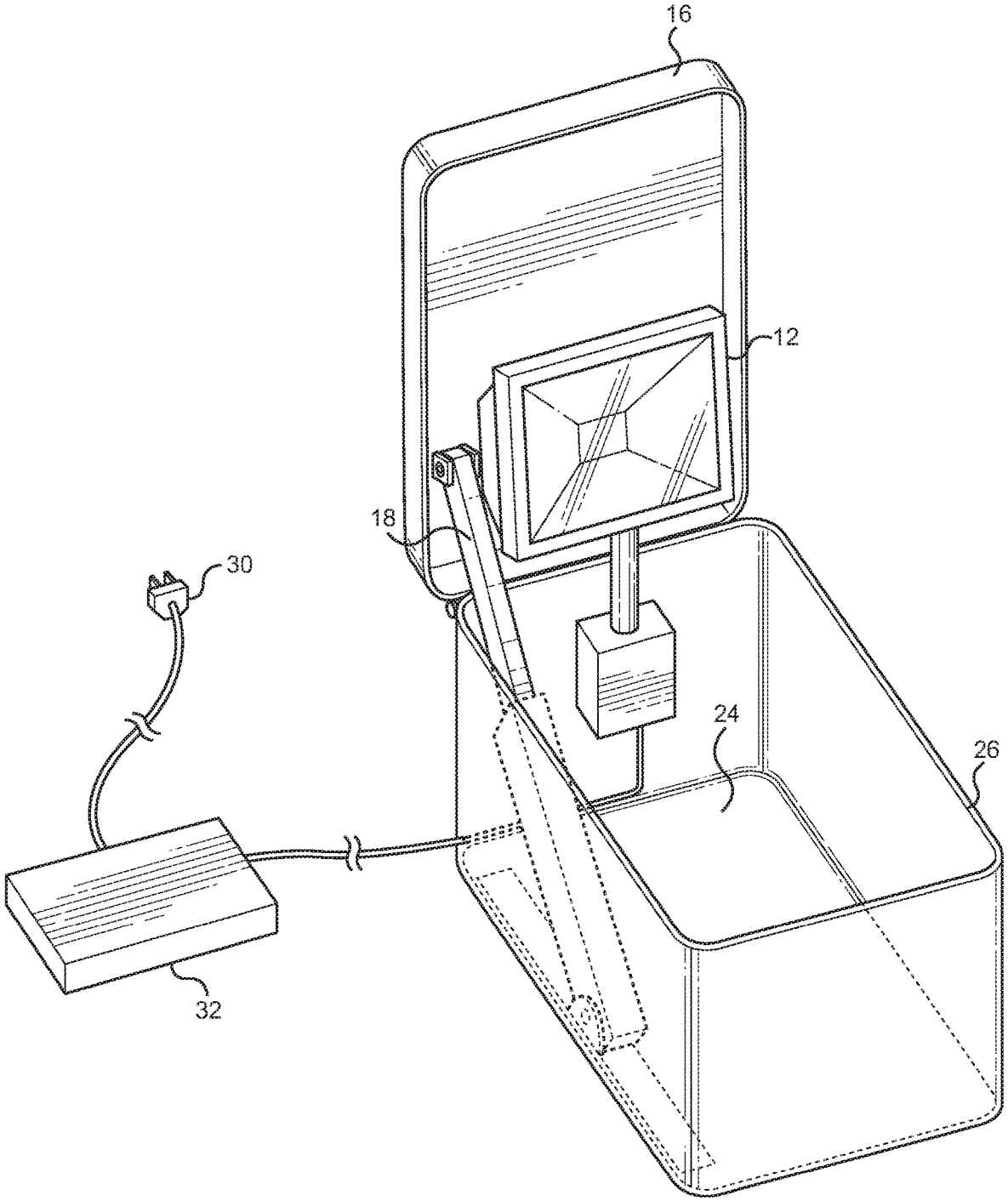
FIG. 2 is a top perspective view of the lighting system of the present invention.

As demonstrated in FIG. 2, lid support 18 is an extendable rod or other appropriate support that, upon electrical actuation, is constructed and arranged to raise and lower lid 16. In this embodiment, lid support base motor is incorporated within lid support 18. As generally understood, junction box 32 receives power from power source 30 and ultimately delivers power to system 10. In one embodiment, power source 30 is a conventional alternating current receptacle plug.

Figure 3:
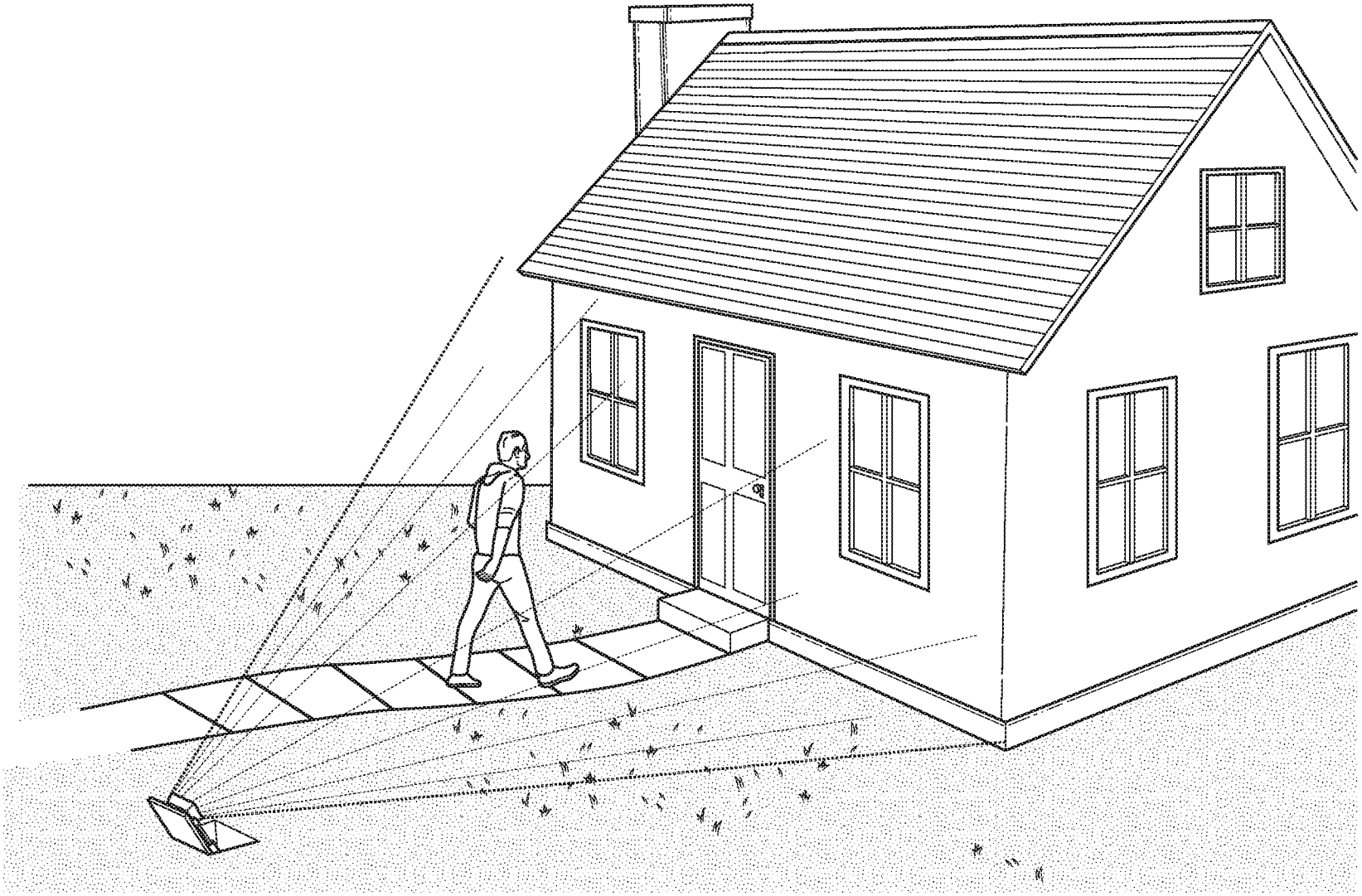
FIG. 3 is a view demonstrative of the present invention in one environment of use.

In one environment of use, as demonstrated in FIG. 3, the unit is buried beneath the surface with the lid 16 being positioned such that it can be raised and lowered along the surface of the ground. As desired, the user will actuate system 10 lid 16 will raise and light 12 will illuminate.

In one embodiment, a motion sensor is operatively associated with system 10. Upon detection of motion, system 10 is actuated, lid 16 is raised, and like 12 is illuminated. in this embodiment, system 10 is configured to illuminate for a particular amount of time after motion actuation occurs. For example, a motion actuating event occurs, system 10 is activated, lid 16 is raised in like 12 is illuminated. A user selectable time, such as five minutes is provided and after the user selectable time has expired like 12 turns off and lid 16 closes.

In another embodiment, system 10 is constructed and arranged with a chronological timer to turn on and off at user selectable times.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A light system comprising:

an enclosure having a central cavity accessible by a lid;

a mechanism constructed and arranged to open and closed said lid based on actuation wherein said mechanism constructed and arranged to open and close said lid is a fixed length lid support movable within said central cavity along a track positioned on said cavity bottom surface constructed and arranged to ultimately open and close said lid as desired;

a light source support having a first end mounted on said lid and having a second end with a light attached thereto;

an actuator; and a source of power.

2. The system of claim 1 wherein said lid opens and closes about a hinge.

3. The system of claim 1 wherein said actuator is a wireless actuator, a hardwired actuator, a motion sensor, a chronological timer, or combinations thereof.

4. The system of claim 1 wherein said source of power is conventionally utilized alternating current.

5. The system of claim 1 wherein said mechanism constructed and arranged to open and close said lid is an extendable lid support.

6. The system of claim 1 wherein said actuator is a motion sensor.

* * * * *